US008979713B2

(12) United States Patent
Huang et al.

(10) Patent No.: US 8,979,713 B2
(45) Date of Patent: Mar. 17, 2015

(54) PEDAL MOTION PATH ADJUSTABLE ELLIPTICAL TRAINER

(71) Applicant: Dyaco International Inc., Taipei (TW)

(72) Inventors: Hsuan-Fu Huang, Hemei Town (TW); Han-Lin Liu, Hemei Town (TW)

(73) Assignee: Dyaco International Inc., Taipei (TW)

( * ) Notice: Subject to any disclaimer, the term of this patent is extended or adjusted under 35 U.S.C. 154(b) by 121 days.

(21) Appl. No.: 13/800,866

(22) Filed: Mar. 13, 2013

(65) Prior Publication Data

US 2014/0194254 A1 Jul. 10, 2014

(30) Foreign Application Priority Data

Jan. 7, 2013 (TW) ..... 102100458 A

(51) Int. Cl.
*A63B 22/00* (2006.01)
*A63B 22/04* (2006.01)
*A63B 71/00* (2006.01)

(52) U.S. Cl.
CPC ..... *A63B 22/04* (2013.01)
USPC ..... 482/52; 482/51

(58) Field of Classification Search
CPC .... A63B 22/04; A63B 22/06; A63B 22/0664; A63B 23/035; A63B 23/03583; A63B 23/03591; A63B 23/04; A63B 23/0423
USPC ..... 482/51–52, 907
See application file for complete search history.

(56) References Cited

U.S. PATENT DOCUMENTS 5,277,681 A * 1/1994 Holt ..... 482/112
7,141,027 B2 * 11/2006 Kassel et al. ..... 601/5
7,425,189 B1 * 9/2008 Eschenbach ..... 482/52
7,582,043 B2 * 9/2009 Liao et al. ..... 482/52
7,618,350 B2 * 11/2009 Dalebout et al. ..... 482/52
7,654,936 B2 * 2/2010 Liao et al. ..... 482/52
7,682,290 B2 * 3/2010 Liao et al. ..... 482/52
7,682,293 B2 * 3/2010 Eschenbach ..... 482/62
7,691,035 B2 * 4/2010 Chen et al. ..... 482/52
7,722,505 B2 * 5/2010 Liao et al. ..... 482/52
7,744,508 B2 * 6/2010 Liao et al. ..... 482/52
7,846,071 B2 * 12/2010 Fenster et al. ..... 482/52
7,972,248 B2 * 7/2011 Liao et al. ..... 482/52
7,976,435 B2 * 7/2011 Van Handel et al. ..... 482/52

(Continued)

FOREIGN PATENT DOCUMENTS

TW I294294 3/2008
TW M403355 5/2011
TW M407086 7/2011

*Primary Examiner* — Oren Ginsberg
*Assistant Examiner* — Gary D Urbiel Goldner
(74) *Attorney, Agent, or Firm* — Huffman Law Group, PC

(57) ABSTRACT

A pedal motion path adjustable elliptical trainer includes a base frame, a rotating mechanism assembly, a lifting mechanism, a sliding mechanism and a control mechanism. The lifting mechanism is biasable relative to the base frame, including a rail holder, a support member and two sliding rails. The rotating mechanism assembly includes two cranks coaxially pivoted with one of each of the ends thereof to the base frame, and a support link set pivotally coupled between the other ends of the cranks and slidably coupled to the sliding rails. The control mechanism is mounted between the base frame and the rail holder to control the angle of deflection of the lifting mechanism. The sliding mechanism is pivotally coupled between the control mechanism and the rail holder. Thus, the invention allows quick adjustment of the pedal motion paths, training different muscles of the legs.

9 Claims, 6 Drawing Sheets

(56) References Cited

U.S. PATENT DOCUMENTS

| | | | | |
|---|---|---|---|---|
| 7,981,015 | B2 * | 7/2011 | Reed | 482/131 |
| 8,403,815 | B2 * | 3/2013 | Liao et al. | 482/52 |
| 8,734,298 | B2 * | 5/2014 | Murray | 482/52 |
| 2007/0298935 | A1 * | 12/2007 | Badarneh et al. | 482/52 |
| 2009/0005222 | A1 * | 1/2009 | Liao et al. | 482/52 |
| 2009/0062081 | A1 * | 3/2009 | Liao et al. | 482/52 |
| 2009/0111663 | A1 * | 4/2009 | Kuo | 482/53 |
| 2009/0124463 | A1 * | 5/2009 | Chen | 482/52 |
| 2009/0312156 | A1 * | 12/2009 | Chen et al. | 482/52 |
| 2010/0093498 | A1 * | 4/2010 | Fenster et al. | 482/52 |
| 2010/0137111 | A1 * | 6/2010 | Van Handel et al. | 482/52 |
| 2010/0216606 | A1 * | 8/2010 | Liao et al. | 482/52 |
| 2012/0077645 | A1 * | 3/2012 | Lee et al. | 482/52 |
| 2012/0088635 | A1 * | 4/2012 | Lee et al. | 482/52 |
| 2013/0237379 | A1 * | 9/2013 | Huang et al. | 482/52 |
| 2013/0244837 | A1 * | 9/2013 | Chen | 482/52 |

* cited by examiner

PEDAL MOTION PATH ADJUSTABLE ELLIPTICAL TRAINER

BACKGROUND OF THE INVENTION

1. Field of the Invention

The present invention relates to elliptical machines and more particularly, to a pedal motion path adjustable elliptical trainer, which allows change of pedal motion paths.

2. Description of the Related Art

An Elliptical trainer is a stationary exercise machine used to simulate walking that moves along a smooth, elliptical path. Elliptical trainers offer a non-impact cardiovascular workout that can help you reach your health and fitness goals. The pedal motion paths of conventional elliptical trainers are constant, hence, the entire exercise will seem tedious, and will be unable to train all different muscles of the legs.

Taiwan Patent 1294294 discloses an elliptical trainer entitled "LEG-TRAINING ELLIPTICAL MACHINE", which uses a screw rod of a slope control mechanism to control movement of a female screw member, causing the female screw member to bias a drag bar. When biasing the drag bar, the angle of a rail holder is changed relative to the floor to adjust the slope of the pedal motion paths. Further, Taiwan Patent M403355 discloses a lifting mechanism for an elliptical trainer, which uses a retractable rod of a linear actuator to adjust the angular position of a lift frame relative to the floor, thereby changing the pedal motion paths. The aforesaid two prior art patents allow control of the elevation of pedals to change the motion paths of sliding bars subject to different requirements from different users. However, the axis of rotation of each pedal is kept in parallel to the reference axis of the rotating mechanism assembly. When viewed from the top side, the left and right pedals can be simply biased in a front-rear direction. Thus, only a small part of the muscles of the legs can be trained during exercise, resulting in poor effects of exercise. In order to improve the drawbacks of the aforesaid two prior art designs, Taiwan Patent M407086 discloses an elliptical trainer, entitled "Improved structure of fitness elliptical machine", which uses two sliding guide rails to control variation of the sliding motion path. The two sliding guide rails are formed of one single tubular member that is bent into a predetermined shape defining a parallel part and a splayed part. However, this design simply allows the machine to perform one specific motion model. If the user wishes to change the outward expansion angle, the user must purchase a different model of elliptical trainer or a different type of sliding rails, causing so much inconvenience.

SUMMARY OF THE INVENTION

The present invention has been accomplished under the circumstances in view. It is the main object of the present invention to provide a pedal motion path adjustable elliptical trainer which allows quick adjustment of the pedal motion paths, so that the user can pedal the pedals to move along respective front and back-biased motion paths and respective left and right-biased motion paths, training different muscles of the legs.

To achieve this object of the present invention, a pedal motion path adjustable elliptical trainer comprises a base frame, a rotating mechanism assembly, a lifting mechanism, a support link set, a control mechanism, and a sliding mechanism. The base frame is mounted on a support surface. The rotating mechanism assembly comprises two cranks coaxially pivoted to the base frame for performing a closed-path motion. The lifting mechanism comprises a rail holder, a support member, and two sliding rails. The rail holder is pivotally connected to the base frame, and biasable relative to the base frame. The rail holder comprises two first stop portions and two second stop portions. Each sliding rail comprises a pivot portion and a sliding portion. The pivot portion is pivoted to the support member. The sliding portion is coupled to the rail holder and movable between one respective first stop portion and one respective second stop portion. Each support link comprises a first end portion and a second end portion. The first end portion is pivoted to one respective crank. The second end portion is slidably coupled to one respective sliding rail. The linkage mechanism set comprises two handlebars and two links. The handlebars are respectively pivotally mounted at opposite left and right sides of the base frame. The links have the respective two opposite ends thereof respectively pivotally coupled between the handlebars and the second end portions of the support link set. The control mechanism is mounted between the base frame and the rail holder, and adapted to control the angle of deflection of the lifting mechanism. The sliding mechanism is pivotally coupled between the control mechanism and the rail holder for enabling the sliding portions of the sliding rails to move on the rail holder relative to each other.

Thus, subject to vertical swinging motion of the lifting mechanism and lateral displacement of the sliding mechanism, the pedal motion path adjustable elliptical trainer enables the user's legs to move along respective front and back-biased motion paths and respective left and right-biased motion paths, training different muscles of the legs.

Other advantages and features of the present invention will be fully understood by reference to the following specification in conjunction with the accompanying drawings, in which like reference signs denote like components of structure.

DETAILED DESCRIPTION OF THE INVENTION

Figure 1:
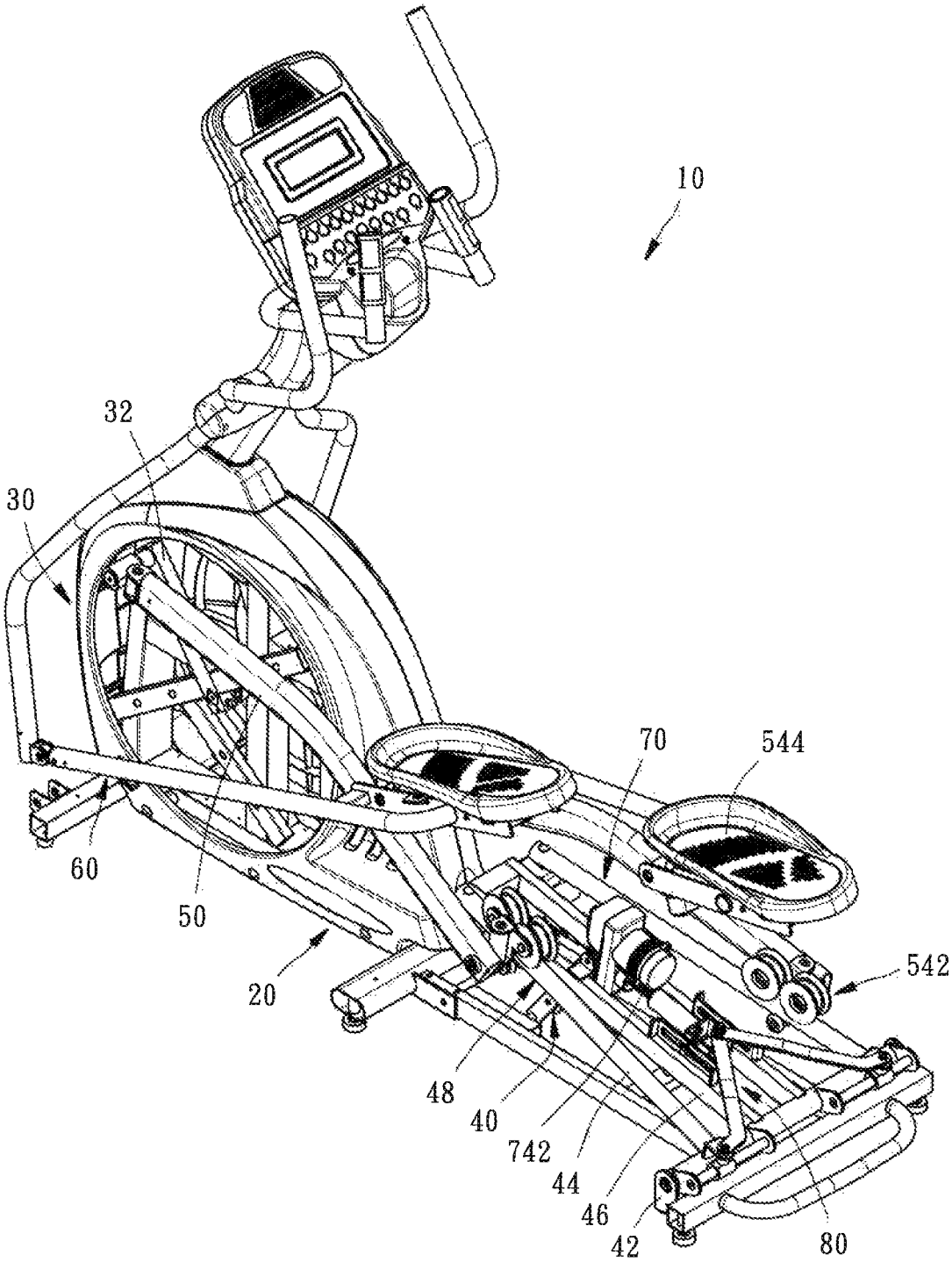
FIG. 1 is an oblique left top elevational view of a pedal motion path adjustable elliptical trainer in accordance with the present invention.
Figure 2:
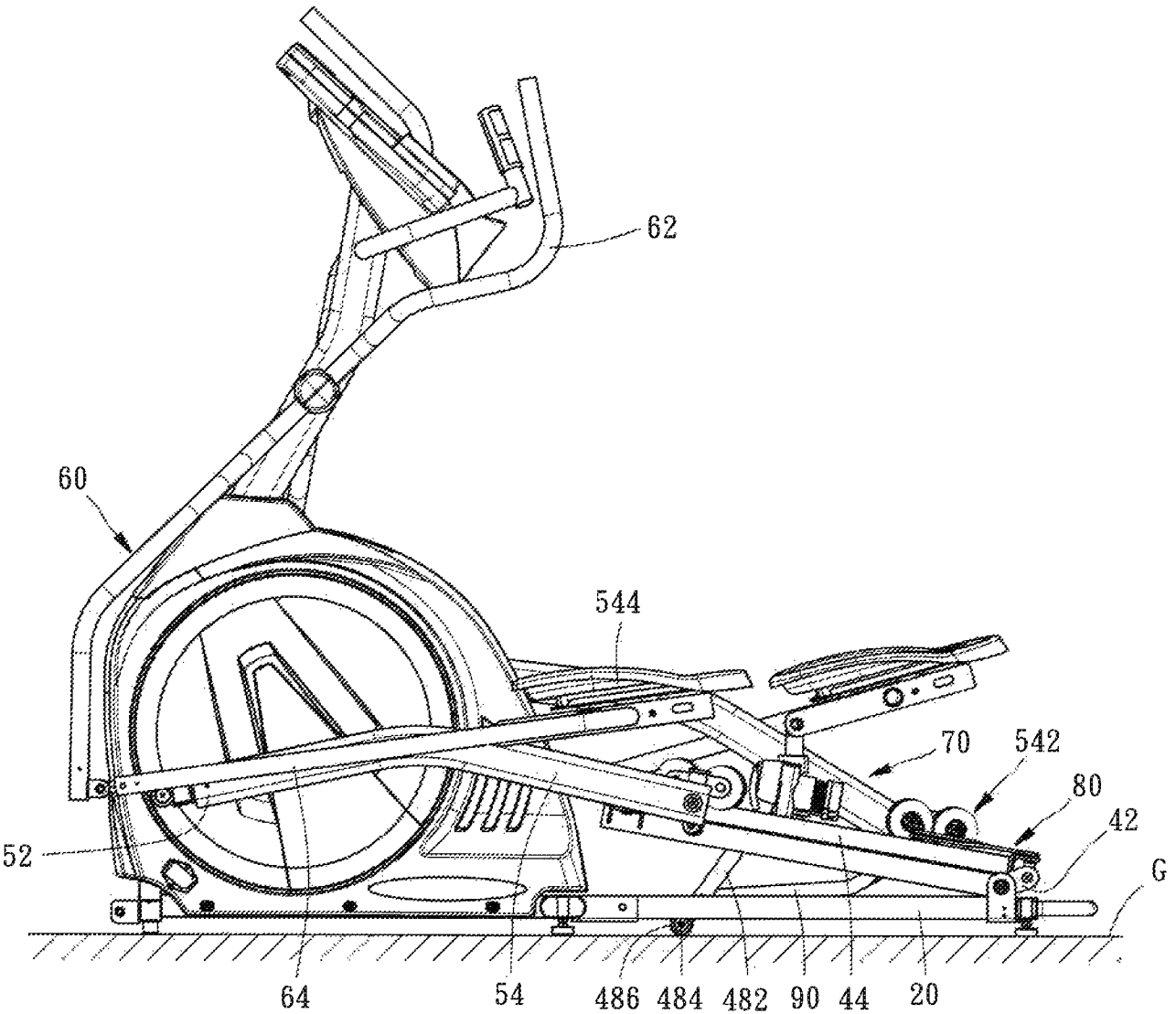
FIG. 2 is a left side view of the pedal motion path adjustable elliptical trainer in accordance with the present invention.
Figure 3:
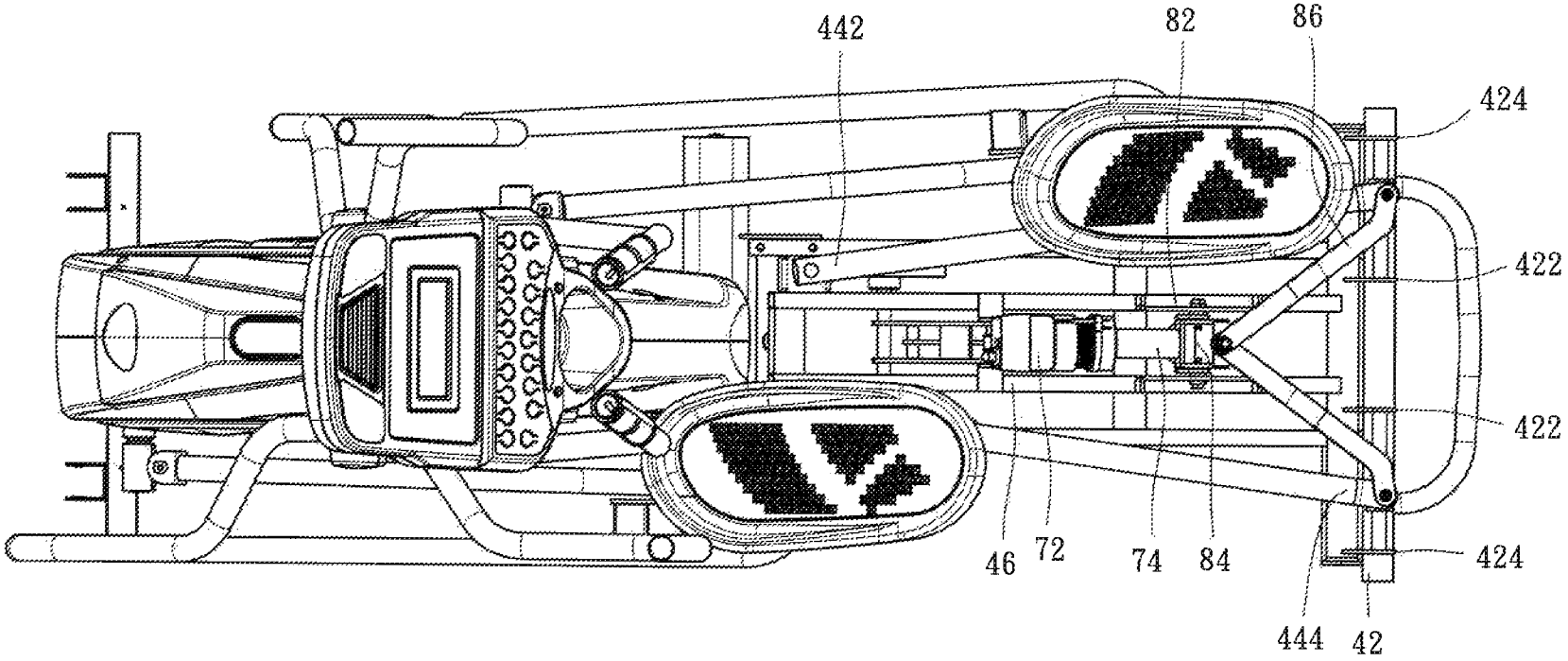
FIG. 3 is a top view of the pedal motion path adjustable elliptical trainer in accordance with the present invention.
Figure 4:
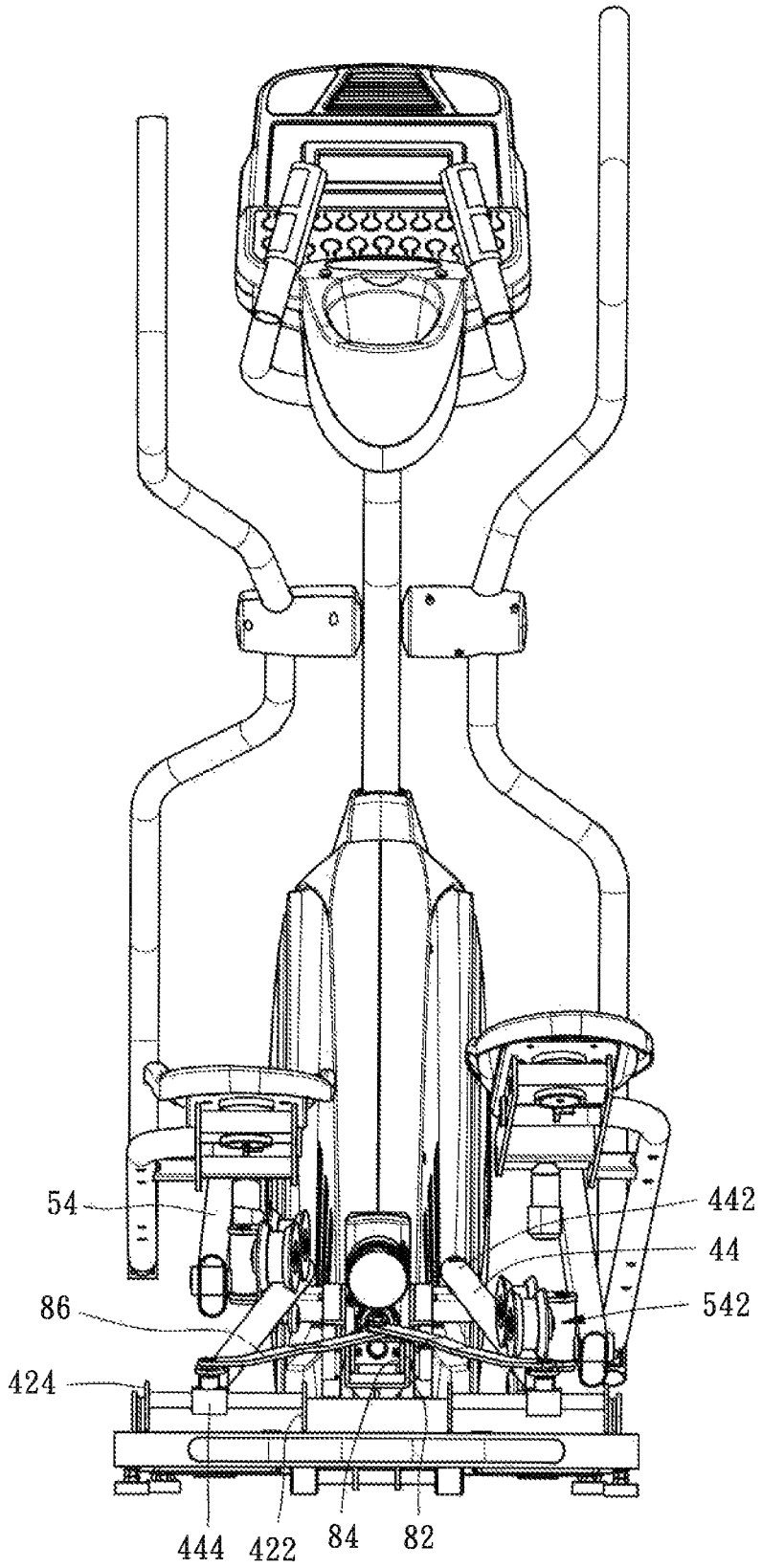
FIG. 4 is a rear side view of the pedal motion path adjustable elliptical trainer in accordance with the present invention.

Referring to FIGS. 1-4, an elliptical trainer 10 in accordance with the present invention is shown comprising a base frame 20, a rotating mechanism assembly 30, a lifting mechanism 40, a support link set 50, a linkage mechanism set 60, a control mechanism 70, a sliding mechanism 80, and a linking-up member 90.

The base frame 20 is mounted at a support surface G.

The rotating mechanism assembly 30 comprises two opposing cranks 32 coaxially pivoted to the base frame 20 to perform a closed-path motion.

The lifting mechanism 40 comprises a rail holder 42, two sliding rails 44, a support member 46, and a bracket 48. The rail holder 42 is pivotally connected to the base frame 20 and biasable relative to the base frame 20, comprising two first stop portions 422 and two second stop portions 424. Each sliding rail 44 comprises a pivot portion 442 and a sliding portion 444. The pivot portion 442 is pivoted to the support member 46. The sliding portion 444 is movable on the rail holder 42 between one respective first stop portion 422 and one respective second stop portion 424. The bracket 48 comprises a frame rod 482, a wheel axle 484, and two rollers 486. The frame rod 482 is pivotally connected to the support member 46 of the lifting mechanism 40 and the front end of the linking-up member 90. The wheel axle 484 is connected to the bottom end of the frame rod 482. The two rollers 486 are rotatably mounted at the two opposite ends of the wheel axle 484 for stopping against the support surface G.

The support link set 50 comprises two opposing first end portions 52 and two second end portions 54. Each of the two first end portions 52 is pivoted to one respective crank 32. Each of the two second end portions 54 is mounted with a pulley block 542 that is supported on one respective sliding rail 44, enabling the second end portion 54 to move along the respective sliding rail 44. The support link set 50 further comprises two pedals 544 respectively arranged at the top side of the second end portion 54 and biasable on the longitudinal axis thereof in a left-right direction.

The linkage mechanism set 60 comprises two handlebars 62 and two links 64. The two handlebars 62 are respectively disposed at left and right sides relative to the base frame 20. The links 64 are respectively pivotally connected between the handlebars 62 and the second end portions 54 of the support link set 50.

The control mechanism 70 is mounted between the base frame 20 and the rail holder 42, comprising a motor 72 and a drive rod 74. The motor 72 is mounted at the support member 46 of the lifting mechanism 40. The drive rod 74 is mounted at the rear side of the motor 72, and movable forwards and backwards relative to the motor 72.

The sliding mechanism 80 is pivotally mounted between the control mechanism 70 and the rail holder 42, comprising a locating block 82, a slide 84 and two connection members 86. The locating block 82 is fixedly mounted at the support member 46 of the lifting mechanism 40. The slide 84 is affixed to the drive rod 74 and movably supported on the locating block 82. The connection members 86 have the front ends thereof pivotally connected to the slide 84, and the rear ends thereof slidably coupled to the rail holder 42 and movable relative to each other for moving the sliding portions 444 of the sliding rails 44 on the rail holder 42 relative to each other.

The linking-up member 90 has the two opposite ends thereof respectively pivotally connected to the support member 46 of the lifting mechanism 40 and the slide 84 of the sliding mechanism 80, and adapted to bias the support member 46 up and down relative to the support surface G subject to change of the length of the drive rod 74 and to simultaneously drive the sliding rails 44 to turn about the axes of the respective pivot portions 442 in performing a scissor action.

Figure 5:
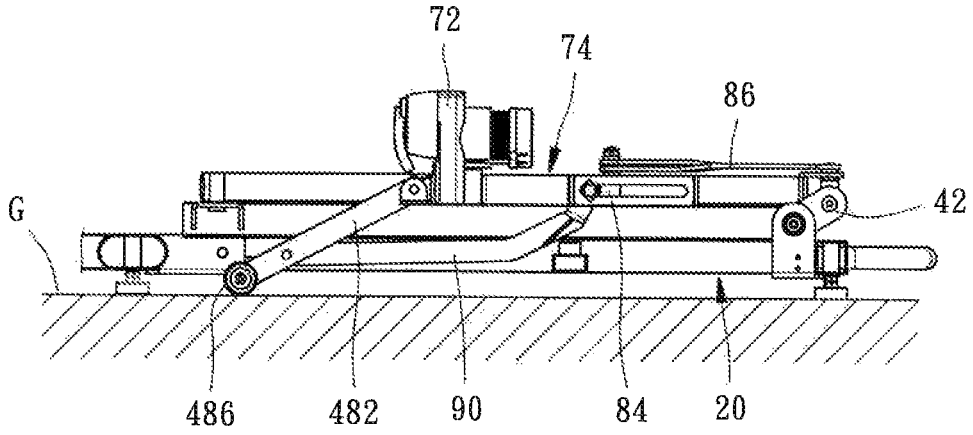
FIG. 5 is a side view, in an enlarged scale, of a part of the present invention, illustrating the status of the lifting mechanism before lift and the status of the sliding mechanism before lateral displacement.
Figure 6:
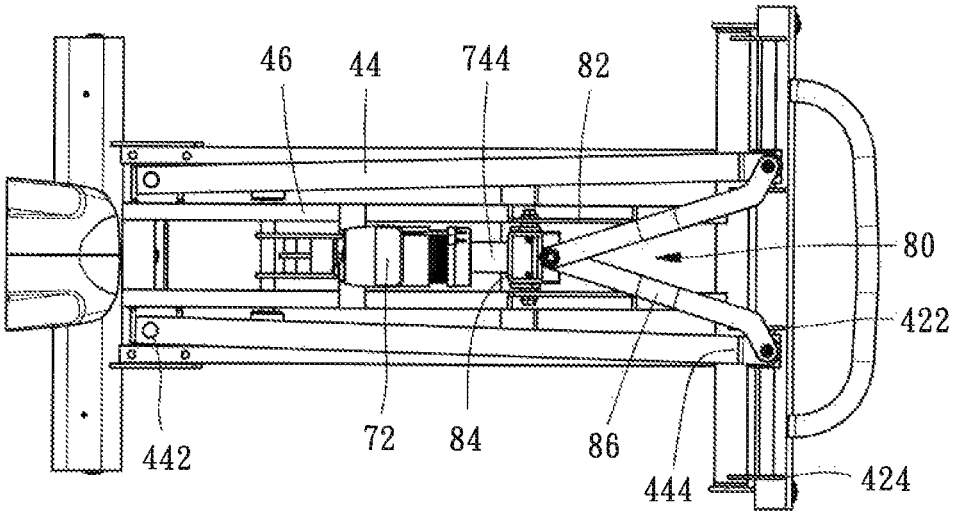
FIG. 6 is a top view, in an enlarged scale, of a part of the present invention, illustrating the status of the lifting mechanism before lift and the status of the sliding mechanism before lateral displacement.
Figure 7:
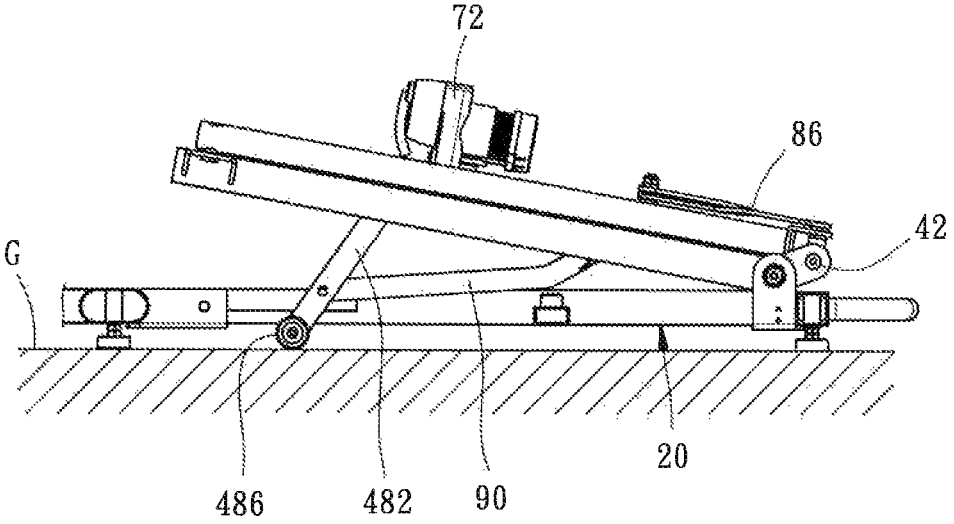
FIG. 7 corresponds to FIG. 5, illustrating the lifting mechanism lifted and the sliding mechanism displaced laterally.
Figure 8:
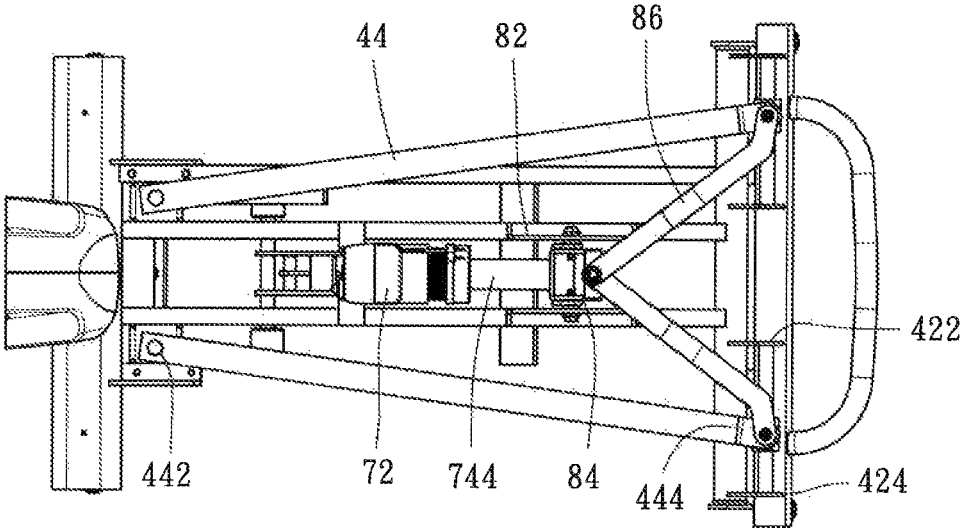
FIG. 8 corresponds to FIG. 6, illustrating the lifting mechanism lifted and the sliding mechanism displaced laterally.

Referring to FIGS. 5 and 8, the drive rod 74 comprises a screw rod 742 and a socket nut 744. The screw rod 742 has its one end connected to the motor 72 so that the motor 72 can rotate the screw rod 742. The socket nut 744 is threaded onto the screw rod 742 and pivotally coupled with the slide 84, and can be driven by screw rod 742 to move axially along the screw rod 742 and to further carry the sliding mechanism 80. Thus, when the user wishes to change the motion path of the pedals 544, the user can start the motor 72 to rotate the screw rod 742 of the drive rod 74. At this time, the socket nut 744 of the drive rod 74 will be driven by the screw rod 74 to move the slide 84 backwards, causing the connection members 86 to be biased relative to the slide 84 toward the respective second stop portions 424. Further, subject to the arrangement that the linking-up member 90 has the two opposite ends thereof respectively pivotally connected to the support member 46 of the lifting mechanism 40 and the slide 84 of the sliding mechanism 80 and the bracket 48 is pivotally connected to the support member 46 of the lifting mechanism 40, moving the slide 84 backwards can drive the support member 46 to make a relative motion, causing the bracket 48 to move with the rollers 486 along the support surface G stably backwards. During movement of the bracket 48 along the support surface G, the lifting mechanism 40 will be forced to turn the support member 46 about the axis of the rail holder 42 upwardly to a predetermined angle relative to the support surface G. Thus, the pedals 544 are lifted with the support member 46 of the lifting mechanism 40 to change their angle of inclination. At this time, subject to the arrangement that the pivot portions 442 of the sliding rails 44 of the lifting mechanism 40 are pivoted to the support member 46 and the connection members 86 of the sliding mechanism 80 have the respective front ends thereof respectively pivotally connected to the slide 84 and the respective rear ends thereof respectively slidably coupled to the rail holder 42 and respectively pivotally coupled to the sliding portions 444 of the sliding rails 44, the sliding rails 44 will be turned about the axes of the respective pivot portions 442, causing the sliding portions 444 to be moved from the respective first stop portions 422 of the rail holder 42 toward the respective second stop portions 424. Thus, the pedals 544 can be pedaled to move along respective front and back-biased motion paths and respective left and right-biased motion paths, training different muscles of the user's legs.

Although a particular embodiment of the invention has been described in detail for purposes of illustration, various modifications and enhancements may be made without departing from the spirit and scope of the invention. Accordingly, the invention is not to be limited except as by the appended claims.

What is claimed is:

1. A pedal motion path adjustable elliptical trainer, comprising:

a base frame adapted to be mounted on a support surface;

a lifting mechanism comprising a rail holder, a support member and two sliding rails, said rail holder being pivotally connected to said base frame and biasable relative to said base frame, said rail holder comprising two first stop portions and two second stop portions, each said sliding rail comprising a pivot portion pivotally coupled to said support member and a sliding portion slidably coupled to said rail holder;

a rotating mechanism assembly comprising two opposing cranks and a support link set, said two cranks being coaxially pivotally connected to said base frame, said support link set comprising two opposing first end portions and two second end portions, each of said two first end portions of said support link set being pivotally connected to one of said two cranks, each of said two second end portions of said support link set being slidably coupled to one of said two sliding rails to perform a closed-path motion;

a linkage mechanism set comprising two handlebars respectively pivotally connected to an opposing left side and right side of said base frame and two links respectively pivotally connected between said handlebars and said second end portions of said support link set;

a control mechanism mounted between said base frame and said rail holder and adapted to control the angle of deflection of said lifting mechanism; and a sliding mechanism pivotally coupled between said control mechanism and said rail holder for enabling said sliding portions of said sliding rails to be moved relatively to each other between said first stop portions and said second stop portions of said rail holder.

2. The pedal motion path adjustable elliptical trainer as claimed in claim 1, wherein said sliding mechanism comprises a locating block fixedly mounted at said support member of said lifting mechanism, a slide slidably coupled to said locating block, and two connection members each having a respective front end thereof respectively pivotally connected to said slide and a respective rear end thereof respectively coupled to said rail holder and slidable on said rail holder relative to each other.

3. The pedal motion path adjustable elliptical trainer as claimed in claim 2, wherein said control mechanism comprises a motor mounted at said support member of said lifting mechanism, and a drive rod fixedly connected to said slide and movable forwards and backwards.

4. The pedal motion path adjustable elliptical trainer as claimed in claim 3, wherein said lifting mechanism comprises a bracket pivotally connected to said support member and stopped against said support surface.

5. The pedal motion path adjustable elliptical trainer as claimed in claim 4, wherein said drive rod comprises a screw rod and a socket nut, said screw rod having one end thereof connected to said motor and rotatable by said motor, said socket being threaded onto said screw rod and pivotally coupled with said slide and drivable by said screw rod to move along said screw rod and to further carry said connection member.

6. The pedal motion path adjustable elliptical trainer as claimed in claim 5, further comprising a linking-up member, said linking-up member having two opposite ends thereof respectively pivotally connected to said support member of said lifting mechanism and said slide of said sliding mechanism, and adapted to bias said support member up and down relative to said support surface subject to a change of the length of said drive rod and to simultaneously drive said sliding rails to turn about axes of the respective pivot portions thereof in performing a scissor action.

7. The pedal motion path adjustable elliptical trainer as claimed in claim 6, wherein said bracket comprises a frame rod, a wheel axle and two rollers, said frame rod being pivotally connected to said support member of said lifting mechanism and a front end of said linking-up member, said wheel axle being connected to a bottom end of said frame rod, said two rollers being rotatably mounted at two opposite ends of said wheel axle and supported on said support surface.

8. The pedal motion path adjustable elliptical trainer as claimed in claim 1, wherein said rotating mechanism assembly further comprises two pedals respectively mounted at the second end portions of said support link set at a top side, each said pedal being biasable in a left-right direction on a longitudinal axis thereof.

9. The pedal motion path adjustable elliptical trainer as claimed in claim 1, wherein said second end portion of each said support link is mounted with a pulley block and supported on said sliding rail.

* * * * *